US007530556B1

(12) United States Patent
Zheng

(10) Patent No.: US 7,530,556 B1
(45) Date of Patent: May 12, 2009

(54) BAR CLAMP WITH ARRANGEMENT FOR DISPLACING A CLAMPING JAW A LARGE DISTANCE TO SECURELY CLAMP A WORKPIECE

(76) Inventor: Bo Ren Zheng, 6F, 86, Sec. 2, Liming Road, Taichung (TW)

( * ) Notice: Subject to any disclaimer, the term of this patent is extended or adjusted under 35 U.S.C. 154(b) by 0 days.

(21) Appl. No.: 12/135,219

(22) Filed: Jun. 9, 2008

(51) Int. Cl.
*B25B 5/14* (2006.01)

(52) U.S. Cl. ..... 269/6; 269/3; 269/236; 269/249; 269/143; 269/166

(58) Field of Classification Search ..... 269/6, 269/3, 143, 249, 95, 170, 166–168, 236
See application file for complete search history.

(56) References Cited

U.S. PATENT DOCUMENTS

| | | | | |
|---|---|---|---|---|
| 3,575,405 | A * | 4/1971 | Harding | 269/258 |
| D439,487 | S * | 3/2001 | Renner | D8/72 |
| 6,648,314 | B1 * | 11/2003 | Degen et al. | 269/6 |
| 7,040,609 | B1 * | 5/2006 | Liou | 269/6 |
| 2008/0136077 | A1 * | 6/2008 | Yang | 269/6 |
| 2008/0277849 | A1 * | 11/2008 | Phillips et al. | 269/6 |

* cited by examiner

*Primary Examiner*—Lee D Wilson

(57) ABSTRACT

A bar clamp has an operating handle being in ratchet engagement with end teeth of a slide bar. The operating handle is adapted to pivot counterclockwise to cause a first clamping jaw carrier to displace along the slide bar and then pivot about a lock pin in the slide bar so as to displace a first clamping jaw a sufficiently large distance to securely clamp a workpiece by cooperating with a corresponding clamping jaw.

2 Claims, 6 Drawing Sheets

BAR CLAMP WITH ARRANGEMENT FOR DISPLACING A CLAMPING JAW A LARGE DISTANCE TO SECURELY CLAMP A WORKPIECE

BACKGROUND OF THE INVENTION

1. Field of Invention

The invention relates to bar clamps and more particularly to a bar clamp having an arrangement for displacing a clamping jaw a large distance in order to securely clamp a workpiece by cooperating with a corresponding clamping jaw.

2. Description of Related Art

A conventional eccentric clamp disclosed in U.S. Pat. No. 6,648,314 is shown in FIGS. 1 and 2. The clamp operates as below. A workpiece is preliminarily clamped between a clamping jaw of a fixed but pivotable clamping jaw carrier 12 and a clamping jaw of a displaceable clamping jaw carrier 10. Next, counterclockwise pivot an operating handle 11 about 180 degrees to cause the clamping jaw carrier 12 to pivot a predetermined small angle so as to longitudinally displace the clamping jaw of the clamping jaw carrier 12 a predetermined distance as indicated by Y.

However, the patented clamp suffers from a disadvantage. In detail, the displacement distance Y is relatively small. Hence, the clamping force exerted upon the workpiece is not sufficient. It is understood that a user has to latch and unlatch the operating handle 11 a number of times before the workpiece can be securely clamped. Thus, a need for improvement exists.

SUMMARY OF THE INVENTION

It is therefore one object of the invention to provide a bar clamp having an arrangement for displacing a clamping jaw a large distance in order to securely clamp a workpiece by cooperating with a corresponding clamping jaw.

The above and other objects, features and advantages of the invention will become apparent from the following detailed description taken with the accompanying drawings.

DETAILED DESCRIPTION OF THE INVENTION

Referring to FIGS. 3 to 6, a bar clamp in accordance with a preferred embodiment of the invention comprises the following components. Each component is discussed in detail below.

A slide bar 20 comprises an arcuate toothed section 21 on a front end, a substantially triangular channel 22 proximate the toothed section 21, and a lengthwise elongated slot 23 behind the channel 22.

Figure 1:
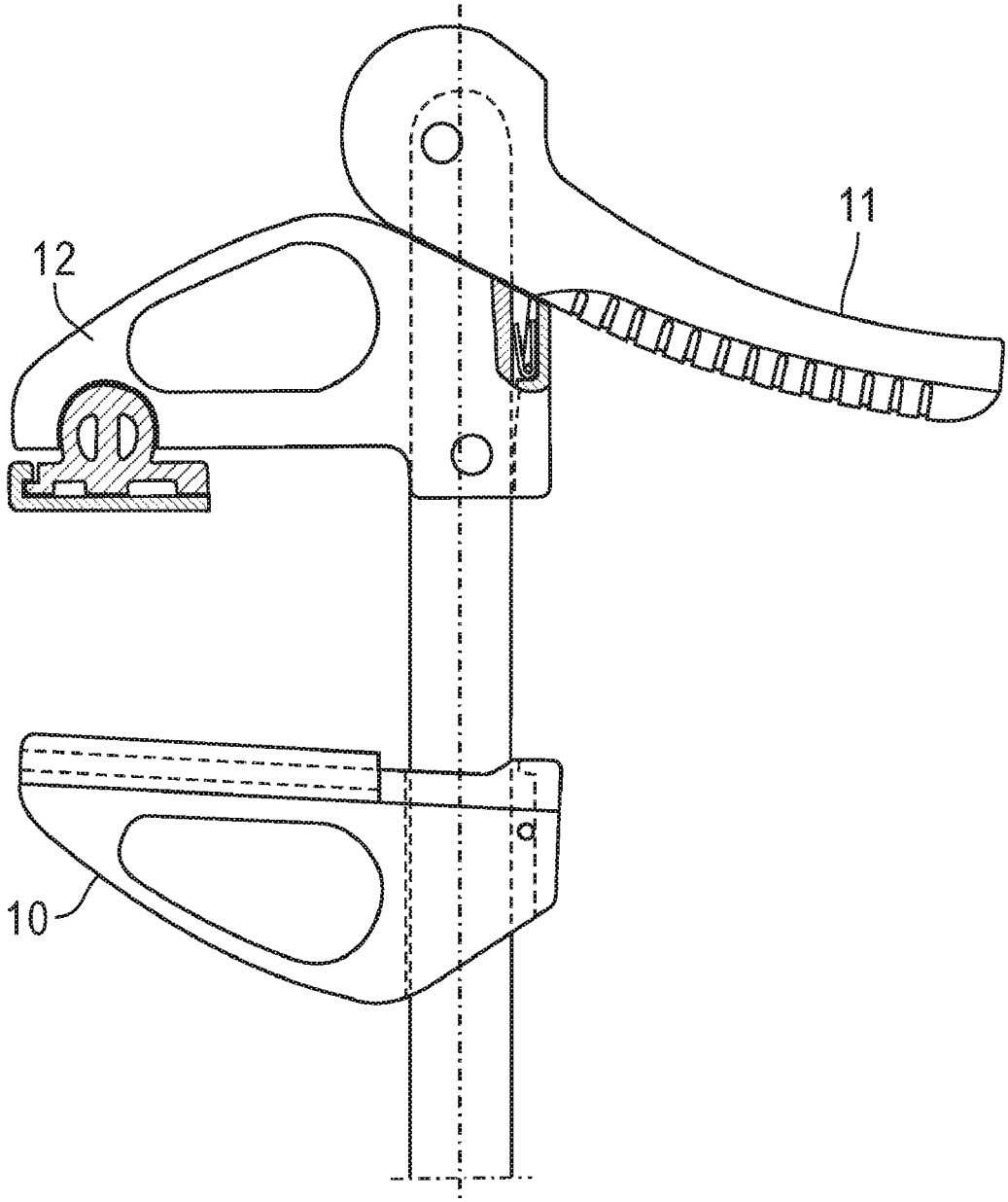
FIG. 1 PRIOR ART
FIG. 1 is a side phantom view in part section of a conventional clamp.
Figure 2:
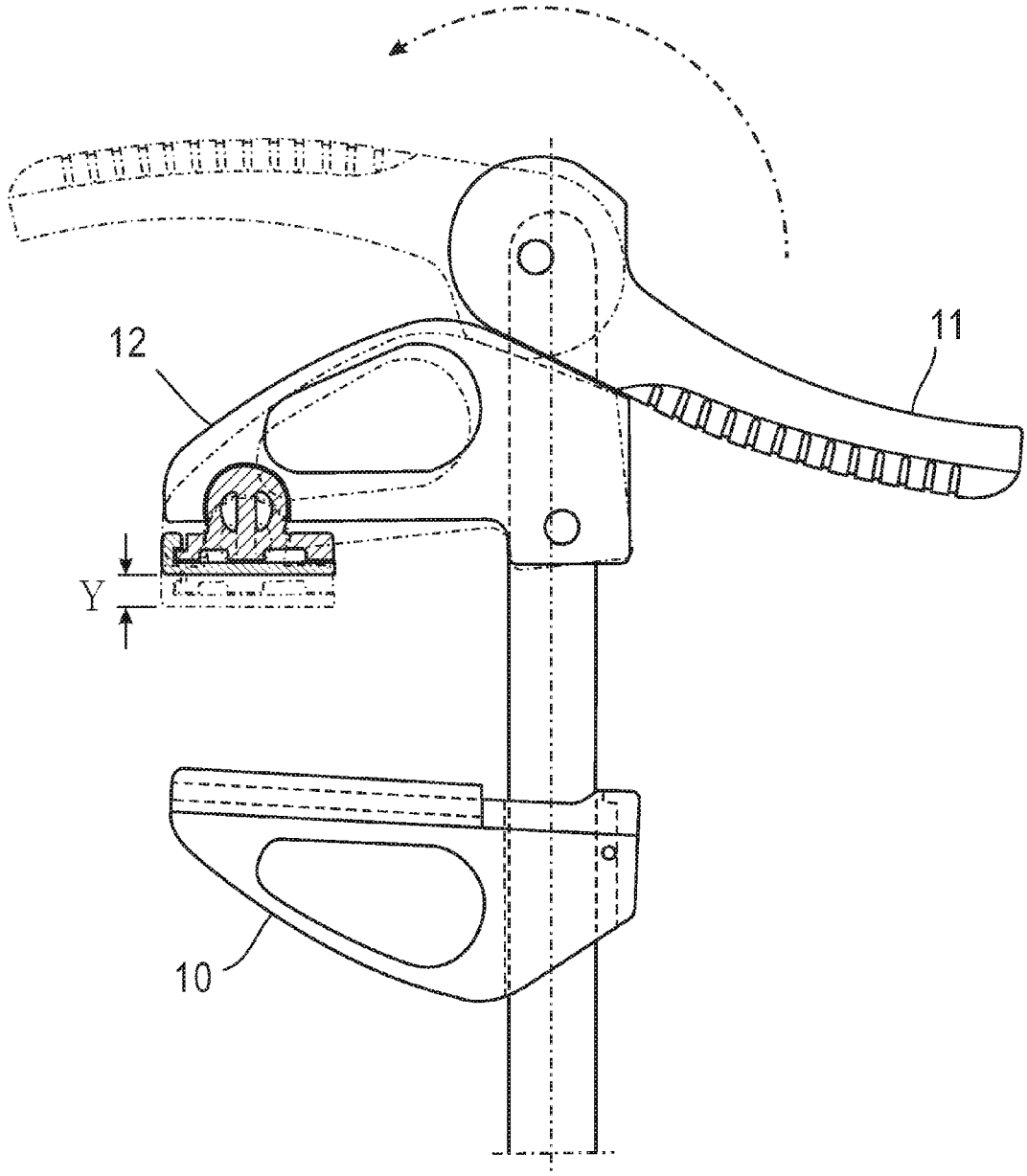
FIG. 2 PRIOR ART
FIG. 2 is a view similar to FIG. 1 where a clamping operation by pivoting an operating handle is shown.
Figure 3:
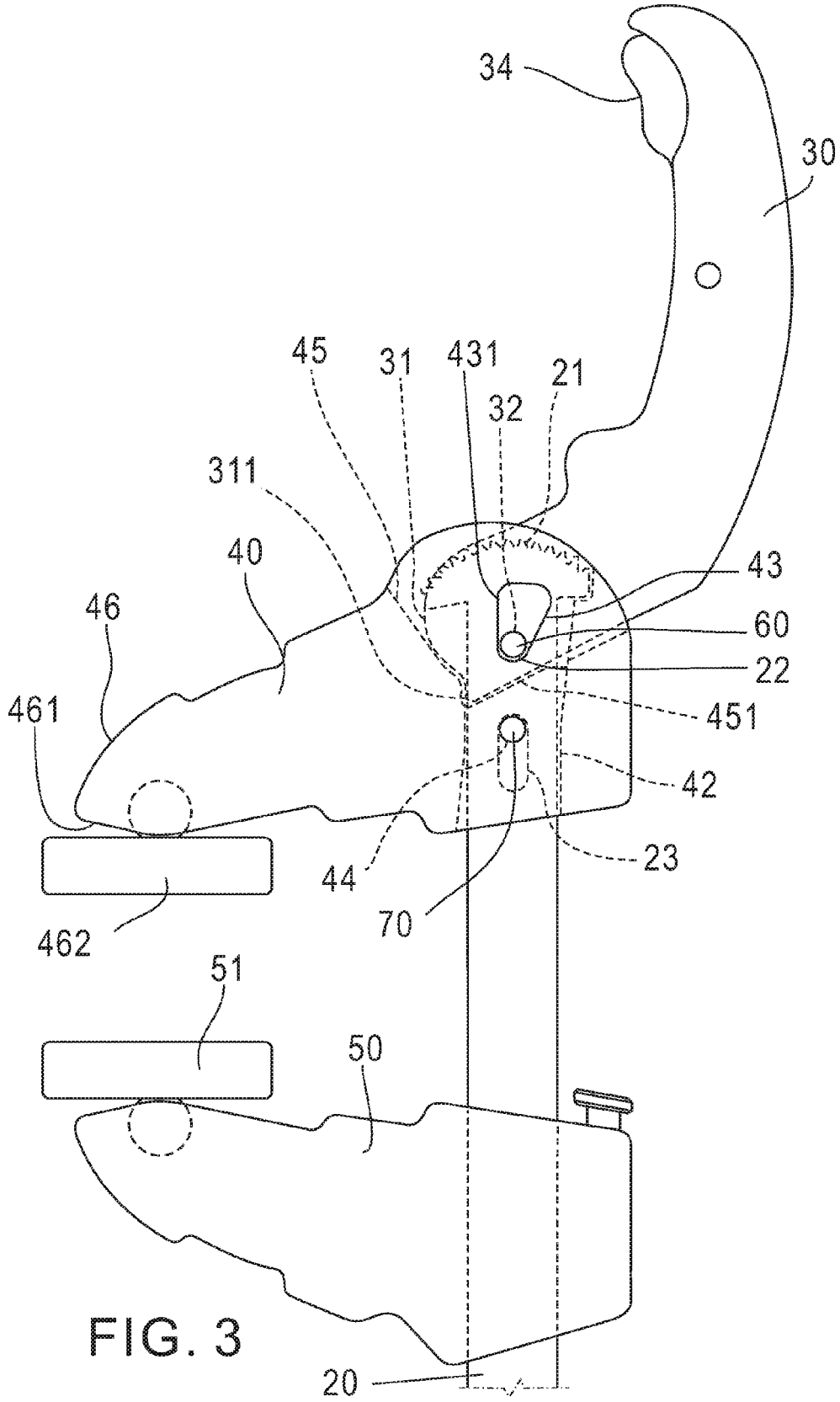
FIG. 3 is a side phantom view of a preferred embodiment of bar clamp according to the invention.
Figure 4:
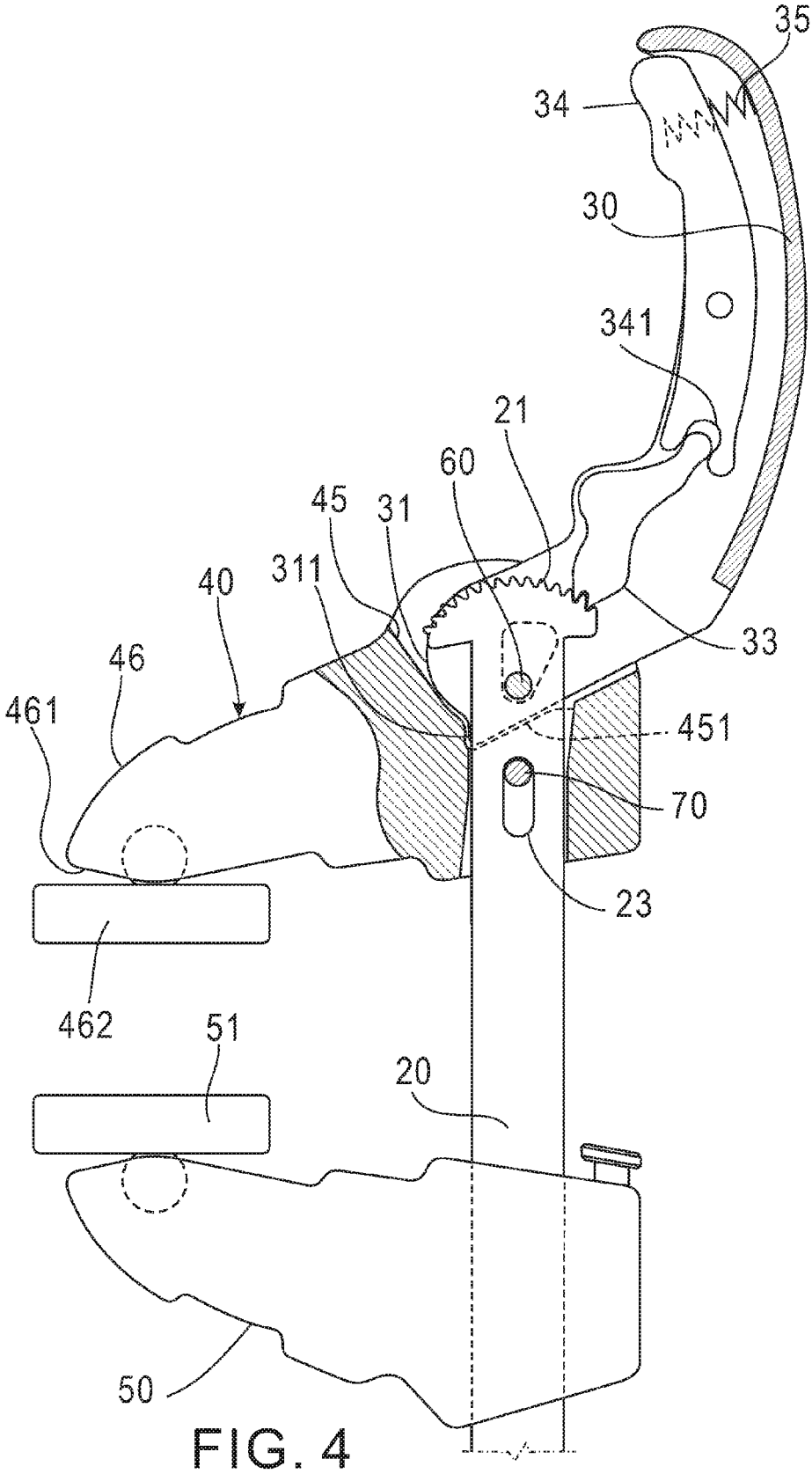
FIG. 4 is a side phantom view in part section of the bar clamp of FIG. 3 where the bar clamp is in an inoperative position.
Figure 5:
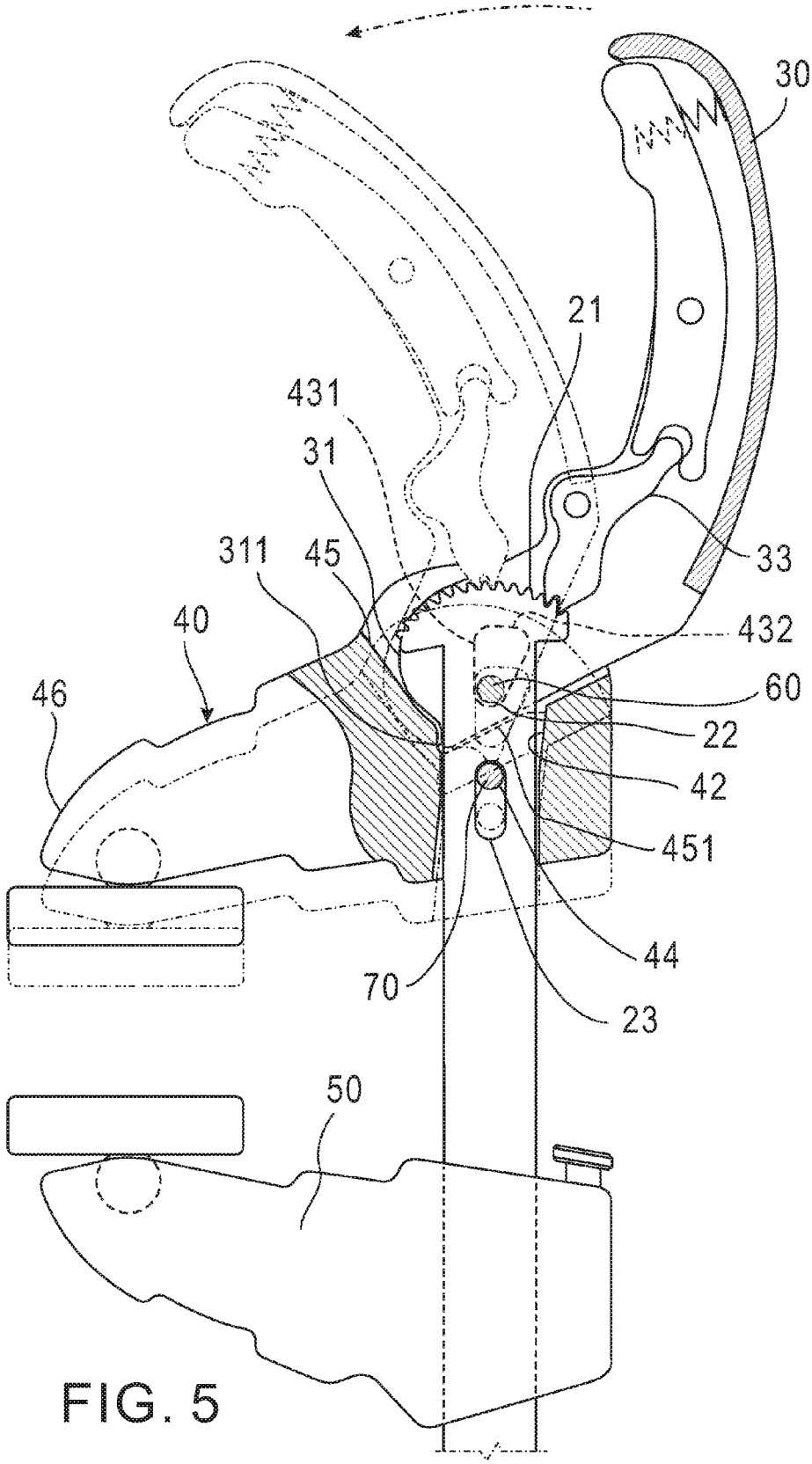
FIGS. 5 and 6 are views similar to FIG. 4 showing the operating handle being counterclockwise pivoted to advance and pivot the first clamping jaw carrier in a clamping operation.

A first clamping jaw carrier 40 comprises a compartment 42 with the slide bar 20 extending through, a pivot hole 44 aligned with the slot 23, and a triangular hole 43 aligned with the channel 22, the triangular hole 43 having a longitudinal surface 431 and a transverse surface 432 shown in phantom lines of FIG. 5.

An operating handle 30 is hollow and comprises a pivot hole 32 aligned with both the hole 43 and the channel 22, a large arcuate pressure surface 31 at one end engaged with a first oblique surface 45 of the first clamping jaw carrier 40, a small arcuate pressure surface 311 continuous with the large arcuate pressure surface 31 also at one end, the small arcuate pressure surface 311 engaged with a joining point of the first oblique surface 45 and a second oblique surface 451 of the first clamping jaw carrier 40, a pivotal release level 34 provided in the hollow of the operating handle 30, a compression spring 35 anchored between an end of the operating handle 30 and an end of the release level 34, and an intermediate ratchet member 33 having one end retained in a cavity 341 at the other end of the release level 34 and the other end formed with ratchet teeth which are engaged with the toothed section 21.

A pin 60 is provided across the channel 22, the triangular hole 43, and the pivot hole 32 in order to pivotably secure the operating handle 30, the slide bar 20, and the first clamping jaw carrier 40 together.

A lock pin 70 is provided across the slot 23 and the pivot hole 44 in order to slidably secure the first clamping jaw carrier 40 to the slide bar 20.

An arcuate clamping section 46 is formed on an end of the first clamping jaw carrier 40 distal the slide bar 20. The clamping section 46 has an end 461 and a first clamping jaw 462 pivotably secured to the end 461.

A second clamping jaw carrier 50 is provided opposite the first clamping jaw carrier 40 and has a compartment (not numbered) with the slide bar 20 extending through so that the second clamping jaw carrier 50 is capable of displacing along the slide bar 20. The second clamping jaw carrier 50 has a second clamping jaw 51 which is also pivotably secured to its end. The second clamping jaw 51 is opposite the first clamping jaw 462.

A clamping operation of the invention will be described in detail below. In FIG. 5, a workpiece (not shown) is preliminarily clamped between the first clamping jaw 462 of the displaceable pivotable first clamping jaw carrier 40 and the second clamping jaw 51 of the displaceable second clamping jaw carrier 50 by moving the second clamping jaw carrier 50 toward the first clamping jaw carrier 40. Next, counterclockwise pivot the operating handle 30 an acute angle as indicated by an arrow shown in a phantom line to move the ratchet member 33 along the toothed section 21. Also, the large arcuate pressure surface 31 exerts a pressure on the first oblique surface 45 of the first clamping jaw carrier 40 and the small arcuate pressure surface 311 exerts a pressure on the second oblique surface 451 of the first clamping jaw carrier 40 respectively. Hence, the triangular hole 43 moves downward, i.e., the longitudinal surface 431 thereof moving downward by engaging with the pin 60. Also, the first clamping jaw carrier 40 moves downward relative to the slide bar 20 by sliding the lock pin 70 downward relative to and along the slot 23.

Figure 6:
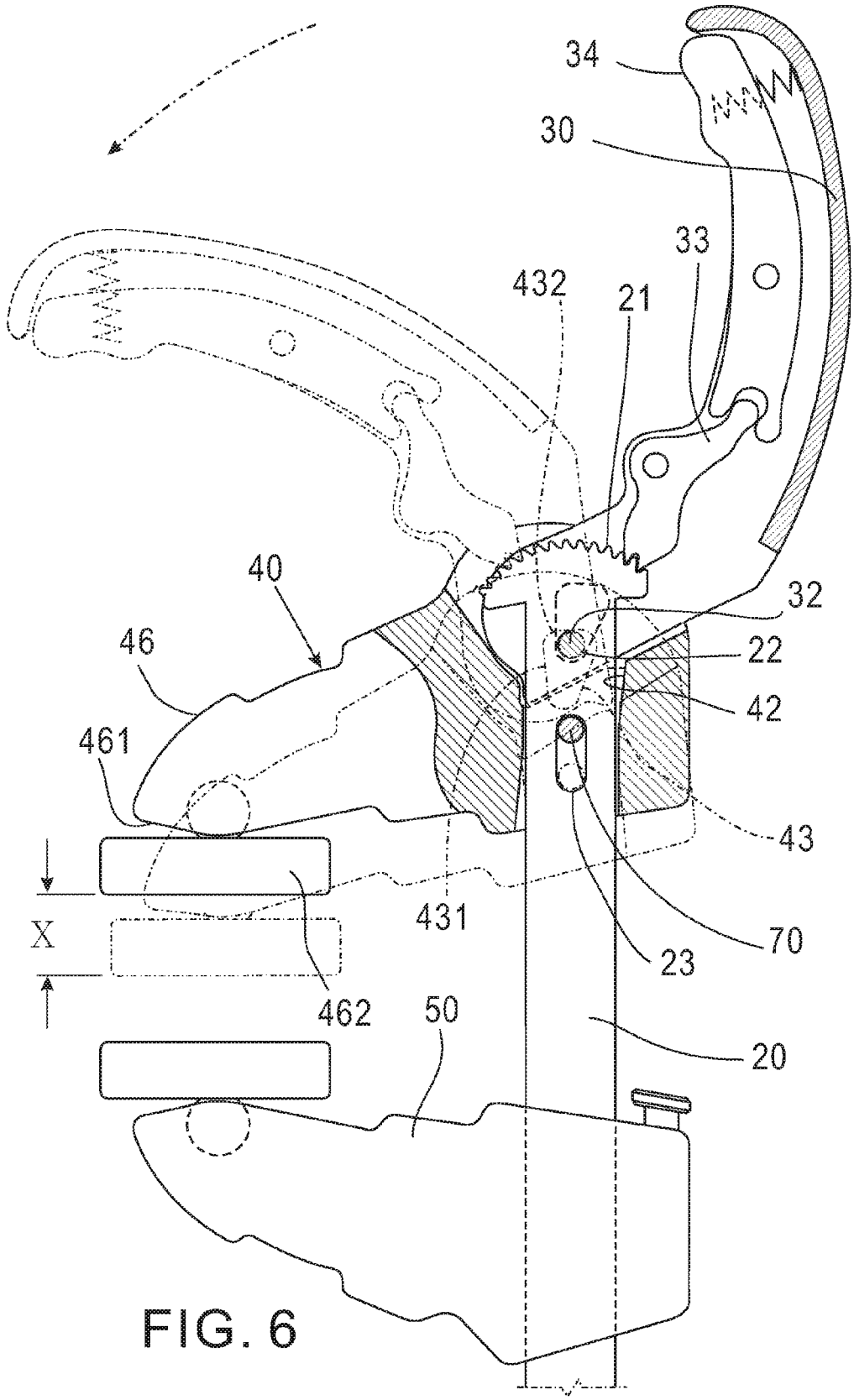

In FIG. 6, further counterclockwise pivot the operating handle 30 another acute angle as indicated by an arrow shown in a phantom line to move the ratchet member 33 along the toothed section 21. Also, the large arcuate pressure surface 31 exerts a pressure on the first oblique surface 45 of the first clamping jaw carrier 40. The longitudinal movement of the first clamping jaw carrier 40 will be stopped when the lock pin 70 engages with the bottom end of the slot 23. After stopping, the first clamping jaw carrier 40 immediately pivots counterclockwise about the lock pin 70. Also, the transverse surface 432 of the triangular hole 43 moves leftward relative to the pin 60 by engaging therewith. Hence, the first clamping jaw carrier 40 pivots counterclockwise to cause the first clamping jaw 462 to displace a large distance as indicated by X. As a result, the workpiece is securely clamped. It is understood that a pressing of the release level 34 can disengage the ratchet member 33 from the toothed section 21 and a next clockwise pivoting of the operating handle 30 can return the operating handle 30 to its original inoperative position.

While the invention herein disclosed has been described by means of specific embodiments, numerous modifications and variations could be made thereto by those skilled in the art without departing from the scope and spirit of the invention set forth in the claims.

What is claimed is:

1. A bar clamp comprising:

a slide bar (20) comprising an arcuate toothed section (21) on a front end, a substantially triangular channel (22) proximate the toothed section (21), and a lengthwise elongated slot (23) behind the channel (22);

a first clamping jaw carrier (40) slidably mounted on a front portion of the slide bar (20), a pivot hole (44), a triangular hole (43) aligned with the channel (22), a first clamping jaw (462) at one end, a first surface (45) at the other end, and a second surface (451) at the other end forming an acute angle relative to the first surface (45);

a hollow operating handle (30) comprising a pivot hole (32) proximate one end, a first arcuate pressure surface (31) at one end being engaged with the first surface (45), a second arcuate pressure surface (311) continuous with the first arcuate pressure surface (31) and being engaged with the second surface (451), a spring-biased pivotal release level (34) at the other end, and an intermediate ratchet member (33) having the other end pivotably secured to one end of the release level (34) and one end being in tooth engagement with the toothed section (21);

a pin (60) disposed across the channel (22), the triangular hole (43), and the pivot hole (32) for pivotably securing the operating handle (30), the slide bar (20), and the first clamping jaw carrier (40) together;

a lock pin (70) disposed across the slot (23) and the pivot hole (44) for slidably securing the first clamping jaw carrier (40) to the slide bar (20); and a second clamping jaw carrier (50) displaceably mounted on a rear portion of the slide bar (20) and comprising a second clamping jaw (51) at one end opposite the first clamping jaw (462);

whereby preliminarily clamping a workpiece between the first clamping jaw (462) and the second clamping jaw (51) by moving the second clamping jaw carrier (50) toward the first clamping jaw carrier (40), and counterclockwise pivoting the operating handle (30) will move the ratchet member (33) along the toothed section (21) to cause the first arcuate pressure surface (31) to exert a pressure on the first surface (45), cause the second arcuate pressure surface (311) to exert a pressure on the second surface (451) respectively, move down the triangular hole (43), move the first clamping jaw carrier (40) toward the second clamping jaw carrier (50) by sliding down the lock pin (70) relative to and along the slot (23) until the lock pin (70) is stopped by the bottom end of the slot (23), pivot the first clamping jaw carrier (40) counterclockwise about the lock pin (70), move the triangular hole (43) transversely relative to the pin (60), and displace the first clamping jaw (462) a predetermined distance so as to securely clamp the workpiece.

2. The bar clamp of claim 1, wherein each of the first clamping jaw (462) and the second clamping jaw (51) is pivotal.

* * * * *